US006743757B2

(12) United States Patent
Bell et al.

(10) Patent No.: US 6,743,757 B2
(45) Date of Patent: Jun. 1, 2004

(54) DISPERSANTS AND LUBRICATING OIL COMPOSITIONS CONTAINING SAME

(75) Inventors: Ian A. W. Bell, Oxon (GB); Jacob Emert, Brooklyn, NY (US); Raymond Fellows, Oxfordshire (GB); Antonio Gutierrez, Mercerville, NJ (US); Robert Robson, Oxfordshire (GB)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 10/010,668

(22) Filed: Dec. 6, 2001

(65) Prior Publication Data

US 2003/0148898 A1 Aug. 7, 2003

(51) Int. Cl.[7] ..... C10M 159/12

(52) U.S. Cl. ..... 508/192; 508/185; 508/232; 508/293; 508/364; 508/454; 508/518

(58) Field of Search ..... 508/192, 293

(56) References Cited

U.S. PATENT DOCUMENTS

| | | | | | |
|---|---|---|---|---|---|
| 3,087,936 | A | | 4/1963 | Le Suer | 260/326.3 |
| 3,254,025 | A | | 5/1966 | Le Suer | 252/32.7 |
| 4,234,435 | A | | 11/1980 | Meinhardt et al. | 252/51.5 A |
| 4,863,624 | A | * | 9/1989 | Emert et al. | 252/51.5 A |
| 4,873,004 | A | * | 10/1989 | Beverwijk et al. | 252/32.5 |
| 5,118,432 | A | * | 6/1992 | Emert et al. | 252/49.6 |
| 5,716,912 | A | * | 2/1998 | Harrison et al. | 508/192 |
| 5,756,428 | A | * | 5/1998 | Emert et al. | 508/192 |
| 6,127,321 | A | | 10/2000 | Emert et al. | 508/192 |
| 6,358,892 | B1 | * | 3/2002 | Harrison et al. | 508/192 |

* cited by examiner

*Primary Examiner*—Ellen M McAvoy

(57) ABSTRACT

A dispersant that is a reaction product of a polyalkenyl-substituted mono- or dicarboxylic acid, anhydride or ester; and a polyamine, wherein the reaction product has from greater than about 1.3 to less than about 1.7 mono- or di-carboxylic acid producing moieties per polyalkenyl moiety, and the polyalkenyl moiety has a number average molecular weight of at least about 1800, and a molecular weight distribution ($M_w/M_n$) of from about 1.5 to about 2.0.

23 Claims, No Drawings

DISPERSANTS AND LUBRICATING OIL COMPOSITIONS CONTAINING SAME

The present invention relates to dispersants for lubricating oil compositions and lubricating oil compositions that contain such dispersants. More particularly, the present invention relates to dispersants that provide excellent control of sludge/varnish formation and soot induced viscosity increase in lubricating oil compositions upon use, and which further provide improved piston cleanliness and ring-sticking performance.

BACKGROUND OF THE INVENTION

Additives have been commonly used to try to improve the performance of lubricating oils for gasoline and diesel engines. Additives, or additive packages, may be used for a number of purposes, such as to improve detergency, reduce engine wear, stabilize a lubricating oil against heat and oxidation, reduce oil consumption, inhibit corrosion and reduce friction loss. "Dispersants" are used to maintain in suspension, within the oil, insoluble materials formed by oxidation and other mechanisms during the use of the oil, and prevent sludge flocculation and the precipitation of insoluble materials. Another function of the dispersant is to prevent the agglomeration of soot particles, thus reducing increases in the viscosity of the lubricating oil upon use. Crankcase lubricants providing improved performance, including acceptable soot dispersing characteristics, have been continuously demanded.

In addition, users of crankcase lubricants, particularly original equipment manufacturers (OEM's) have required lubricants to meet ever more stringent performance criteria. One such performance criterion involves piston cleanliness. A severe test of piston cleanliness is the VW TDi test (VW-PV1452; CEC L-78-T-99). Another performance criterion measured by this test is "ring-sticking", which refers to the sticking of piston rings during the operation of compression-ignited (diesel) internal combustion engines.

Most dispersants in use today are reaction products of (1) a polyalkenyl-substituted mono- or dicarboxylic acid, anhydride or ester (e.g., polyisobutenyl succinic anhydride), also commonly referred to as a carboxylic acid acylating agent; and (2) a nucleophilic reactant (e.g., an amine, alcohol, amino alcohol or polyol). The ratio of mono- or dicarboxylic acid producing moieties per polyalkenyl moieties can be referred to as the "functionality" of the acylating agent. In order to improve dispersant performance, the trend has been to increase the functionality of the dispersant backbone, and ultimately, increase the average number of nucleophilic moieties per dispersant molecule.

U.S. Pat. No. 4,234,435 describes acylating agents that are hydrocarbyl-substituted dicarboxylic acids derived from polyalkenes having a number average molecular weight of 1300 to 5000, and at least 1.3 (e.g., 1.3 to 4.5) dicarboxylic acid groups per polyalkene, wherein the molecular weight distribution ($M_w/M_n$) of the polyalkene moiety is in a range of from 1.5 to about 4.

It is also known that dispersants that are the reaction product of a carboxylic acid acylating agent and an amine, alcohol, amino alcohol or polyol can be further reacted with a boron compound in order to provide the dispersant with improved wear, corrosion and seal compatibility characteristics. Boration of nitrogen-containing dispersants is generally taught in U.S. Pat. Nos. 3,087,936 and 3,254,025. U.S. Pat. No. 4,234,435, discussed supra, discloses optional post-treatment, including the optional boration, of high functionality dispersants. U.S. Pat. No. 6,127,321 discloses a formulation containing a dispersant having a moderate succination ratio, which dispersant may be borated.

Lubricating compositions formulated to include a dispersant or dispersants with an average functionality of about 1.0 to 1.2 have been found to provide adequate piston cleanliness performance, but an insufficient level of dispersancy. The use of a dispersant or dispersants with higher functionality improves the level of dispersancy, but adversely impacts piston cleanliness performance. Thus, it would be advantageous to provide a dispersant, or dispersant mixture, that provides improved dispersing characteristics while simultaneously exhibiting excellent piston cleanliness. The present inventors have now found that by controlling simultaneously the functionality of the dispersant, and the molecular weight distribution of the polyalkenyl moiety of the dispersant, the ring-sticking and piston cleanliness performance of a lubricating oil (as measured by the VWTDi test) can be improved while maintaining excellent soot and sludge dispersing characteristics.

SUMMARY OF THE INVENTION

In accordance with a first aspect of the invention, there is provided an optimized dispersant composition that comprises one or more dispersants that are polyalkenyl-substituted mono- or dicarboxylic acid, anhydride or ester derivatized by reaction with a nucleophilic reactant, wherein at least one dispersant has a polyalkenyl moiety with a molecular weight distribution of from about 1.5 to about 2.0, and from greater than about 1.3 to less than about 1.7 mono- or dicarboxylic acid producing moieties per polyalkenyl moiety.

In a second aspect of the invention, there is provided a lubricating oil composition comprising a major amount of an oil of lubricating viscosity and a minor amount of a dispersant composition that comprises one or more dispersants that are polyalkenyl-substituted mono- or dicarboxylic acid, anhydride or ester derivatized by reaction with a nucleophilic reactant, wherein at least one dispersant has a polyalkenyl moiety with a molecular weight distribution of from about 1.5 to about 2.0, and from greater than about 1.3 to less than about 1.7 mono- or dicarboxylic acid producing moieties per polyalkenyl moiety.

In a third aspect of the invention, there is provided an additive concentrate comprising from about 20 to 90 wt. % of a normally liquid, substantially inert, organic solvent or diluent, and from about 10 to about 90 wt. % of a dispersant composition that comprises one or more dispersants that are polyalkenyl-substituted mono- or dicarboxylic acid, anhydride or ester derivatized by reaction with a nucleophilic reactant, wherein at least one dispersant has a polyalkenyl moiety with a molecular weight distribution of from about 1.5 to about 2.0, and from greater than about 1.3 to less than about 1.7 mono- or dicarboxylic acid producing moieties per polyalkenyl moiety.

The present invention also includes a method for improving the piston cleanliness and reducing the ring-sticking tendencies of a diesel internal combustion engine, which method comprises lubricating such an engine with a lubricating oil composition comprising a major amount of an oil of lubricating viscosity and a minor amount of a dispersant composition that comprises one or more dispersants that are polyalkenyl-substituted mono- or dicarboxylic acid, anhydride or ester derivatized by reaction with a nucleophilic reactant, wherein at least one dispersant has a polyalkenyl moiety with a molecular weight distribution of from about 1.5 to about 2.0, and from greater than about 1.3 to less than about 1.7 mono- or dicarboxylic acid producing moieties per polyalkenyl moiety.

A further aspect of the invention is directed to a dispersant composition, lubricant, lubricant concentrate or method, as described above, wherein the dispersant composition further contains boron, and a ratio of the wt. % of boron in the finished lubricant composition to wt. % of dispersant nitrogen (B/N) is from about 0.05 to about 0.24.

Other and further objects, advantages and features of the present invention will be understood by reference to the following specification.

DETAILED DESCRIPTION OF THE INVENTION

Dispersants useful in the context of the present invention include the range of nitrogen-containing, ashless (metal-free) dispersants known to be effective to reduce formation of deposits upon use in gasoline and diesel engines, when added to lubricating oils. The ashless, dispersants of the present invention comprise an oil soluble polymeric long chain backbone having functional groups capable of associating with particles to be dispersed. Typically, such dispersants have amine, amine-alcohol or amide polar moieties attached to the polymer backbone, often via a bridging group. The ashless dispersant may be, for example, selected from oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine.

The dispersant present invention comprises at least one polyalkenyl-substituted mono- or dicarboxylic acid, anhydride or ester, which has from greater than about 1.3 to less than about 1.7, preferably from greater than about 1.3 to about 1.6, most preferably from greater than about 1.3 to about 1.5 functional groups (mono- or dicarboxylic acid producing moieties) per polyalkenyl moiety (a medium functionality dispersant). Functionality (F) can be determined according to the following formula:

$$F=(SAP\times M_n)/((112{,}200\times A.I.)-(SAP\times 98)) \quad (1)$$

wherein SAP is the saponification number (i.e., the number of milligrams of KOH consumed in the complete neutralization of the acid groups in one gram of the succinic-containing reaction product, as determined according to ASTM D94); $M_n$ is the number average molecular weight of the starting olefin polymer; and A.I. is the percent active ingredient of the succinic-containing reaction product (the remainder being unreacted olefin polymer, succinic anhydride and diluent).

Generally, each mono- or dicarboxylic acid-producing moiety will react with a nucleophilic group (amine, alcohol, amide or ester polar moieties) and the number of functional groups in the polyalkenyl-substituted carboxylic acylating agent will determine the number of nucleophilic groups in the finished dispersant.

The polyalkenyl moiety of the dispersant of the present invention has a number average molecular weight of from about at least about 1800, preferably between 1800 and 3000, such as between 2000 and 2800, more preferably from about 2100 to 2500, and most preferably from about 2200 to about 2400. The molecular weight of a dispersant is generally expressed in terms of the molecular weight of the polyalkenyl moiety as the precise molecular weight range of the dispersant depends on numerous parameters including the type of polymer used to derive the dispersant, the number of functional groups, and the type of nucleophilic group employed.

Polymer molecular weight, specifically $\overline{M}_n$, can be determined by various known techniques. One convenient method is gel permeation chromatography (GPC), which additionally provides molecular weight distribution information (see W. W. Yau, J. J. Kirkland and D. D. Bly, "Modem Size Exclusion Liquid Chromatography", John Wiley and Sons, New York, 1979). Another useful method for determining molecular weight, particularly for lower molecular weight polymers, is vapor pressure osmometry (see, e.g., ASTM D3592).

The polyalkenyl moiety from which dispersants of the present invention may be derived has a narrow molecular weight distribution (MWD), also referred to as polydispersity, as determined by the ratio of weight average molecular weight ($M_w$) to number average molecular weight ($M_n$). Specifically, polymers from which the dispersants of the present invention are derived have a $M_w/M_n$ of from about 1.5 to about 2.0, preferably from about 1.5 to about 1.9, most preferably from about 1.6 to about 1.8.

Suitable hydrocarbons or polymers employed in the formation of the dispersants of the present invention include homopolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ wherein $R^1$ is straight or branched chain alkyl radical comprising 1 to 26 carbon atoms and wherein the polymer contains carbon-to-carbon unsaturation, preferably a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms. Therefore, useful alpha-olefin monomers and comonomers include, for example, propylene, butene-1, hexene-1, octene-1, 4-methylpentene-1, decene-1, dodecene-1, tridecene-1, tetradecene-1, pentadecene-1, hexadecene-1, heptadecene-1, octadecene-1, nonadecene-1, and mixtures thereof (e.g., mixtures of propylene and butene-1, and the like). Exemplary of such polymers are propylene homopolymers, butene-1 homopolymers, ethylene-propylene copolymers, ethylene-butene-1 copolymers, propylene-butene copolymers and the like, wherein the polymer contains at least some terminal and/or internal unsaturation. Preferred polymers are unsaturated copolymers of ethylene and propylene and ethylene and butene-1. The interpolymers of this invention may contain a minor amount, e.g. 0.5 to 5 mole % of a $C_4$ to $C_{18}$ non-conjugated diolefin comonomer. However, it is preferred that the polymers of this invention comprise only alpha-olefin homopolymers, interpolymers of alpha-olefin comonomers and interpolymers of ethylene and alpha-olefin comonomers. The molar ethylene content of the polymers employed in this invention is preferably in the range of 0 to 80%, and more preferably 0 to 60%. When propylene and/or butene-1 are employed as comonomer(s) with ethylene, the ethylene content of such copolymers is most preferably between 15 and 50%, although higher or lower ethylene contents may be present.

These polymers may be prepared by polymerizing alpha-olefin monomer, or mixtures of alpha-olefin monomers, or mixtures comprising ethylene and at least one $C_3$ to $C_{28}$ alpha-olefin monomer, in the presence of a catalyst system comprising at least one metallocene (e.g., a cyclopentadienyl-transition metal compound) and an alumoxane compound. Using this process, a polymer in which 95% or more of the polymer chains possess terminal ethenylidene-type unsaturation can be provided. The percentage of polymer chains exhibiting terminal ethenylidene unsaturation may be determined by FTIR spectroscopic analysis, titration, or $C^{13}$ NMR. Interpolymers of this latter type may be characterized by the formula POLY-C($R^1$)=$CH_2$ wherein $R^1$ is $C_1$ to $C_{26}$ alkyl, preferably $C_1$ to $C_{18}$ alkyl, more preferably $C_1$ to $C_8$ alkyl, and most preferably $C_1$ to $C_2$ alkyl, (e.g., methyl or ethyl) and wherein POLY represents the polymer chain. The chain length of the $R^1$ alkyl group will vary depending on the comonomer(s) selected for use in the polymerization. A minor amount of the polymer chains can contain terminal ethenyl, i.e., vinyl, unsaturation, i.e. POLY-CH=$CH_2$, and a portion of the polymers can contain internal monounsaturation, e.g. POLY-CH=CH($R^1$), wherein $R^1$ is as defined above. These terminally unsaturated interpolymers may be prepared by known metallocene chemistry and may also be prepared as described in U.S. Pat. Nos. 5,498,809; 5,663,130; 5,705,577; 5,814,715; 6,022,929 and 6,030,930.

Another useful class of polymers is polymers prepared by cationic polymerization of isobutene, styrene, and the like. Common polymers from this class include polyisobutenes obtained by polymerization of a $C_4$ refinery stream having a butene content of about 35 to about 75% by wt., and an isobutene content of about 30 to about 60% by wt., in the presence of a Lewis acid catalyst, such as aluminum trichloride or boron trifluoride. A preferred source of monomer for making poly-n-butenes is petroleum feedstreams such as Raffinate II. These feedstocks are disclosed in the art such as in U.S. Pat. No. 4,952,739. Polyisobutylene is a most preferred backbone of the present invention because it is readily available by cationic polymerization from butene streams (e.g., using $AlCl_3$ or $BF_3$ catalysts). Such polyisobutylenes generally contain residual unsaturation in amounts of about one ethylenic double bond per polymer chain, positioned along the chain. A preferred embodiment utilizes polyisobutylene prepared from a pure isobutylene stream or a Raffinate I stream to prepare reactive isobutylene polymers with terminal vinylidene olefins. Preferably, these polymers, referred to as highly reactive polyisobutylene (HR-PIB), have a terminal vinylidene content of at least 65%, e.g., 70%, more preferably at least 80%, most preferably, at least 85%. The preparation of such polymers is described, for example, in U.S. Pat. No. 4,152,499. HR-PIB is known and HR-PIB is commercially available under the tradenames Glissopal™ (from BASF) and Ultravis™ (from BP-Amoco).

Polyisobutylene polymers that may be employed are generally based on a hydrocarbon chain of from about 1800 to 3000. Methods for making polyisobutylene are known. Polyisobutylene can be functionalized by halogenation (e.g. chlorination), the thermal "ene" reaction, or by free radical grafting using a catalyst (e.g. peroxide), as described below.

The hydrocarbon or polymer backbone can be functionalized, e.g., with carboxylic acid producing moieties (preferably acid or anhydride moieties) selectively at sites of carbon-to-carbon unsaturation on the polymer or hydrocarbon chains, or randomly along chains using any of the three processes mentioned above or combinations thereof, in any sequence.

Processes for reacting polymeric hydrocarbons with unsaturated carboxylic acids, anhydrides or esters and the preparation of derivatives from such compounds are disclosed in U.S. Pat. Nos. 3,087,936; 3,172,892; 3,215,707; 3,231,587; 3,272,746; 3,275,554; 3,381,022; 3,442,808; 3,565,804; 3,912,764; 4,110,349; 4,234,435; 5,777,025; 5,891,953; as well as EP 0 382 450 B1; CA-1,335,895 and GB-A-1,440,219. The polymer or hydrocarbon may be functionalized, for example, with carboxylic acid producing moieties (preferably acid or anhydride) by reacting the polymer or hydrocarbon under conditions that result in the addition of functional moieties or agents, i.e., acid, anhydride, ester moieties, etc., onto the polymer or hydrocarbon chains primarily at sites of carbon-to-carbon unsaturation (also referred to as ethylenic or olefinic unsaturation) using the halogen assisted functionalization (e.g. chlorination) process or the thermal "ene" reaction.

Selective functionalization can be accomplished by halogenating, e.g., chlorinating or brominating the unsaturated α-olefin polymer to about 1 to 8 wt. %, preferably 3 to 7 wt. % chlorine, or bromine, based on the weight of polymer or hydrocarbon, by passing the chlorine or bromine through the polymer at a temperature of 60 to 250° C., preferably 110 to 160° C., e.g., 120 to 140° C., for about 0.5 to 10, preferably 1 to 7 hours. The halogenated polymer or hydrocarbon (hereinafter backbone) is then reacted with sufficient monounsaturated reactant capable of adding the required number of functional moieties to the backbone, e.g., monounsaturated carboxylic reactant, at 100 to 250° C., usually about 180° C. to 235° C., for about 0.5 to 10, e.g., 3 to 8 hours, such that the product obtained will contain the desired number of moles of the monounsaturated carboxylic reactant per mole of the halogenated backbones. Alternatively, the backbone and the monounsaturated carboxylic reactant are mixed and heated while adding chlorine to the hot material.

While chlorination normally helps increase the reactivity of starting olefin polymers with monounsaturated functionalizing reactant, it is not necessary with some of the polymers or hydrocarbons contemplated for use in the present invention, particularly those preferred polymers or hydrocarbons which possess a high terminal bond content and reactivity. Preferably, therefore, the backbone and the monounsaturated functionality reactant, e.g., carboxylic reactant, are contacted at elevated temperature to cause an initial thermal "ene" reaction to take place. Ene reactions are known.

The hydrocarbon or polymer backbone can be functionalized by random attachment of functional moieties along the polymer chains by a variety of methods. For example, the polymer, in solution or in solid form, may be grafted with the monounsaturated carboxylic reactant, as described above, in the presence of a free-radical initiator. When performed in solution, the grafting takes place at an elevated temperature in the range of about 100 to 260° C., preferably 120 to 240° C. Preferably, free-radical initiated grafting would be accomplished in a mineral lubricating oil solution containing, e.g., 1 to 50 wt. %, preferably 5 to 30 wt. % polymer based on the initial total oil solution.

The free-radical initiators that may be used are peroxides, hydroperoxides, and azo compounds, preferably those that have a boiling point greater than about 100° C. and decompose thermally within the grafting temperature range to provide free-radicals. Representative of these free-radical initiators are azobutyronitrile, 2,5-dimethylhex-3-ene-2,5-bis-tertiary-butyl peroxide and dicumene peroxide. The initiator, when used, typically is used in an amount of between 0.005% and 1% by weight based on the weight of the reaction mixture solution. Typically, the aforesaid monounsaturated carboxylic reactant material and free-radical initiator are used in a weight ratio range of from about 1.0:1 to 30:1, preferably 3:1 to 6:1. The grafting is preferably carried out in an inert atmosphere, such as under nitrogen blanketing. The resulting grafted polymer is characterized by having carboxylic acid (or ester or anhydride) moieties randomly attached along the polymer chains: it being understood, of course, that some of the polymer chains remain ungrafted. The free radical grafting described above can be used for the other polymers and hydrocarbons of the present invention.

The preferred monounsaturated reactants that are used to functionalize the backbone comprise mono- and dicarboxylic acid material, i.e., acid, anhydride, or acid ester material, including (i) monounsaturated $C_4$ to $C_{10}$ dicarboxylic acid wherein (a) the carboxyl groups are vicinyl, (i.e., located on adjacent carbon atoms) and (b) at least one, preferably both, of said adjacent carbon atoms are part of said mono unsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon-carbon double bond is conjugated with the carboxy group, i.e., of the structure —C═C—CO—; and (iv) derivatives of (iii) such as $C_1$ to $C_5$ alcohol derived mono- or diesters of (iii). Mixtures of monounsaturated carboxylic materials (i)-(iv) also may be used. Upon reaction with the backbone, the monounsaturation of the monounsaturated carboxylic reactant becomes saturated. Thus, for example, maleic anhydride becomes backbone-substituted succinic anhydride, and acrylic acid becomes backbone-substituted propionic acid. Exemplary of such monounsaturated carboxylic reactants are fumaric acid, itaconic acid, maleic acid, maleic anhydride, chloromaleic acid, chloromaleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, and methyl fumarate.

To provide the required functionality, the monounsaturated carboxylic reactant, preferably maleic anhydride, typically will be used in an amount ranging from about equimolar amount to about 100 wt. % excess, preferably 5 to 50 wt. % excess, based on the moles of polymer or hydrocarbon. Unreacted excess monounsaturated carboxylic reactant can be removed from the final dispersant product by, for example, stripping, usually under vacuum, if required.

The functionalized oil-soluble polymeric hydrocarbon backbone is then derivatized with a nucleophilic reactant, such as an amine, amino-alcohol, alcohol, metal compound, or mixture thereof, to form a corresponding derivative. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g., polyalkene and polyoxyalkylene polyamines of about 2 to 60, such as 2 to 40 (e.g., 3 to 20) total carbon atoms having about 1 to 12, such as 3 to 12, preferably 3 to 9, most preferably form about 6 to about 7 nitrogen atoms per molecule. Mixtures of amine compounds may advantageously be used, such as those prepared by reaction of alkylene dihalide with ammonia. Preferred amines are aliphatic saturated amines, including, for example, 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine. Such polyamine mixtures, known as PAM, are commercially available. Particularly preferred polyamine mixtures are mixtures derived by distilling the light ends from PAM products. The resulting mixtures, known as "heavy" PAM, or HPAM, are also commercially available. The properties and attributes of both PAM and/or HPAM are described, for example, in U.S. Pat. Nos. 4,938,881; 4,927,551; 5,230,714; 5,241,003; 5,565,128; 5,756,431; 5,792,730; and 5,854,186.

Other useful amine compounds include: alicyclic diamines such as 1,4-di(aminomethyl) cyclohexane and heterocyclic nitrogen compounds such as imidazolines. Another useful class of amines is the polyamido and related amido-amines as disclosed in U.S. Pat. Nos. 4,857,217; 4,956,107; 4,963,275; and 5,229,022. Also usable is tris (hydroxymethyl)amino methane (TAM) as described in U.S. Pat. Nos. 4,102,798; 4,113,639; 4,116,876; and UK 989,409. Dendrimers, star-like amines, and comb-structured amines may also be used. Similarly, one may use condensed amines, as described in U.S. Pat. No. 5,053,152. The functionalized polymer is reacted with the amine compound using conventional techniques as described, for example, in U.S. Pat. Nos. 4,234,435 and 5,229,022, as well as in EP-A-208,560.

A preferred dispersant composition is one comprising at least one polyalkenyl succinimide, which is the reaction product of a polyalkenyl substituted succinic anhydride (e.g., PIBSA) and a polyamine that has a coupling ratio of from about 0.65 to about 1.25, preferably from about 0.8 to about 1.1, most preferably from about 0.9 to about 1. In the context of this disclosure, "coupling ratio" may be defined as a ratio of the number of succinyl groups in the PIBSA to the number of primary amine groups in the polyamine reactant.

The functionalized, oil-soluble polymeric hydrocarbon backbones may also be derivatized with hydroxy compounds such as monohydric and polyhydric alcohols, or with aromatic compounds such as phenols and naphthols. Preferred polyhydric alcohols include alkylene glycols in which the alkylene radical contains from 2 to 8 carbon atoms. Other useful polyhydric alcohols include glycerol, monooleate of glycerol, monostearate of glycerol, monomethyl ether of glycerol, pentaerythritol, dipentaerythritol, and mixtures thereof. An ester dispersant may also be derived from unsaturated alcohols, such as allyl alcohol, cinnamyl alcohol, propargyl alcohol, 1-cyclohexane-3-ol, and oleyl alcohol. Still other classes of alcohols capable of yielding ashless dispersants comprise ether-alcohols, including oxy-alkylene and oxy-arylene. Such ether-alcohols are exemplified by ether-alcohols having up to 150 oxy-alkylene radicals in which the alkylene radical contains from 1 to 8 carbon atoms. The ester dispersants may be di-esters of succinic acids or acid-esters, i.e., partially esterified succinic acids, as well as partially esterified polyhydric alcohols or phenols, i.e., esters having free alcohols or phenolic hydroxy radicals. An ester dispersant may be prepared by any one of several known methods as described, for example, in U.S. Pat. No. 3,381,022.

Another class of high molecular weight ashless dispersants comprises Mannich base condensation products. Generally, these products are prepared by condensing about one mole of a long chain alkyl-substituted mono- or polyhydroxy benzene with about 1 to 2.5 moles of carbonyl compound(s) (e.g., formaldehyde and paraformaldehyde) and about 0.5 to 2 moles of polyalkylene polyamine, as disclosed, for example, in U.S. Pat. No. 3,442,808. Such Mannich base condensation products may include a polymer product of a metallocene catalyzed polymerization as a substituent on the benzene group, or may be reacted with a compound containing such a polymer substituted on a succinic anhydride in a manner similar to that described in U.S. Pat. No. 3,442,808. Examples of functionalized and/or derivatized olefin polymers synthesized using metallocene catalyst systems are described in the publications identified supra.

The dispersant(s) of the present invention are preferably non-polymeric (e.g., are mono- or bis-succinimides).

The dispersant(s) of the present invention may optionally be borated. Such dispersants can be borated by conventional means, as generally taught in U.S. Pat. Nos. 3,087,936, 3,254,025 and 5,430,105. Boration of the dispersant is readily accomplished by treating an acyl nitrogen-containing dispersant with a boron compound such as boron oxide, boron halide boron acids, and esters of boron acids, in an amount sufficient to provide from about 0.1 to about 20 atomic proportions of boron for each mole of acylated nitrogen composition.

It is not unusual to add a dispersant or other additive, to a lubricating oil, or additive concentrate, in a diluent, such that only a portion of the added weight represents an active ingredient (A.I.). For example, dispersant may be added together with an equal weight of diluent in which case the "additive" is 50% A.I. dispersant. As used herein, the term weight percent (wt. %), when applied to a dispersant or other additive, or to the dispersant composition, refers to the weight of active ingredient.

The boron, which appears in the product as dehydrated boric acid polymers (primarily $(HBO_2)_3$), is believed to attach to the dispersant imides and diimides as amine salts, e.g., the metaborate salt of the diimide. Boration can be carried out by adding a sufficient quantity of a boron compound, preferably boric acid, usually as a slurry, to the acyl nitrogen compound and heating with stirring at from about 135° C. to about 190° C., e.g., 140° C. to 170° C., for from about 1 to about 5 hours, followed by nitrogen stripping. Alternatively, the boron treatment can be conducted by adding boric acid to a hot reaction mixture of the dicarboxylic acid material and amine, while removing water. Other post reaction processes known in the art can also be applied.

Preferably, a lubricant composition formulated with a dispersant of the present invention has a ratio of wt. % composition boron to wt. % dispersant nitrogen (B/N) of from about 0.05 to about 0.24, preferably from about 0.07 to about 0.20, most preferably from about 0.10 to about 0.15. The boron may be boron provided by a borated dispersant, as described above, but may also be provided by a non-dispersant boron source. A lubricating oil composition formulated with a dispersant of the present invention may contain, for example, from about 0.1 to about 0.8 wt. %, preferably from about 0.2 to about 0.4 wt. % boron, based on the total weight of active dispersant in the fully formulated.

Where one or more dispersants of the present invention are used in combination with other dispersants, the use of substantial amounts (for example, above 10 wt. %, such as 30 wt. %, based on the total weight of dispersant) of dispersants having a high functionality (above 1.7) and/or a polydispersity greater than about 2.0 should be avoided.

Non-dispersant boron sources are prepared by reacting a boron compound with an oil-soluble or oil-dispersible additive or compound. Boron compounds include boron oxide, boron oxide hydrate, boron trioxide, boron trifluoride, boron tribromide, boron trichloride, boron acid such as boronic acid, boric acid, tetraboric acid and metaboric acid, boron hydrides, boron amides and various esters of boron acids. Suitable "non-dispersant boron sources" may comprise any oil-soluble, boron-containing compound, but preferably comprise one or more boron-containing additives known to impart enhanced properties to lubricating oil compositions. Such boron-containing additives include, for example, borated dispersant VI improver; alkali metal, mixed alkali metal or alkaline earth metal borate; borated overbased metal detergent; borated epoxide; borate ester; and borate amide.

Alkali metal and alkaline earth metal borates are generally hydrated particulate metal borates, which are known in the art. Alkali metal borates include mixed alkali and alkaline earth metal borates. These metal borates are available commercially. Representative patents describing suitable alkali metal and alkaline earth metal borates and their methods of manufacture include U.S. Pat. Nos. 3,997,454; 3,819,521; 3,853,772; 3,907,601; 3,997,454; and 4,089,790.

The borated amines maybe prepared by reacting one or more of the above boron compounds with one or more of fatty amines, e.g., an amine having from four to eighteen carbon atoms. They may be prepared by reacting the amine with the boron compound at a temperature of from 50 to 300, preferably from 100 to 250° C. and at a ratio from 3:1 to 1:3 equivalents of amine to equivalents of boron compound.

Borated fatty epoxides are generally the reaction product of one or more of the above boron compounds with at least one epoxide. The epoxide is generally an aliphatic epoxide having from 8 to 30, preferably from 10 to 24, more preferably from 12 to 20, carbon atoms. Examples of useful aliphatic epoxides include heptyl epoxide and octyl epoxide. Mixtures of epoxides may also be used, for instance commercial mixtures of epoxides having from 14 to 16 carbon atoms and from 14 to 18 carbon atoms. The borated fatty epoxides are generally known and are described in U.S. Pat. No. 4,584,115.

Borate esters may be prepared by reacting one or more of the above boron compounds with one or more alcohol of suitable oleophilicity. Typically, the alcohol contains from 6 to 30, or from 8 to 24, carbon atoms. Methods of making such borate esters are known in the art.

The borate esters can be borated phospholipids. Such compounds, and processes for making such compounds, are described in EP-A-0 684 298.

Borated overbased metal detergents are known in the art where the borate substitutes the carbonate in the core either in part or in full.

Lubricating oils useful in the practice of the invention may range in viscosity from light distillate mineral oils to heavy lubricating oils such as gasoline engine oils, mineral lubricating oils and heavy duty diesel oils. Generally, the viscosity of the oil ranges from about 2 $mm^2$/sec (centistokes) to about 40 $mm^2$/sec, especially from about 4 $mm^2$/sec to about 20 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly (1-decenes)); alkylbenzenes (e.g., dodecylbenzenes, tetradecylbenzenes, dinonylbenzenes, di(2-ethylhexyl) benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly (methylphenyl)siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service. Such re-refined oils are also known as reclaimed or reprocessed oils and are often subjected to additionally processing using techniques for removing spent additives and oil breakdown products.

The oil of lubricating viscosity may comprise a Group I, Group II, Group III, Group IV or Group V base stocks or base oil blends of the aforementioned base stocks. Preferably, the oil of lubricating viscosity is a Group III, Group IV or Group V base stock, or a mixture thereof provided that the volatility of the oil or oil blend, as measured by the NOACK test (ASTM D5880), is less than or equal to 13.5%, preferably less than or equal to 12%, more preferably less than or equal to 10%, most preferably less than or equal to 8%; and a viscosity index (VI) of at least 120, preferably at least 125, most preferably from about 130 to 140.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a.) Group I base stocks contain less than 90 percent saturates and/or greater than 0.03 percent sulfur and have a viscosity index greater than or equal to 80 and less than 120 using the test methods specified in Table E-1.

b.) Group II base stocks contain greater than or equal to 90 percent saturates and less than or equal to 0.03 percent sulfur and have a viscosity index greater than or equal to 80 and less than 120 using the test methods specified in Table E-1.

c.) Group III base stocks contain greater than or equal to 90 percent saturates and less than or equal to 0.03 percent sulfur and have a viscosity index greater than or equal to 120 using the test methods specified in Table E-1.

d.) Group IV base stocks are polyalphaolefins (PAO).

e.) Group V base stocks include all other base stocks not included in Group I, II, III, or IV.

TABLE E-1

Analytical Methods for Base Stock

| Property | Test Method |
|---|---|
| Saturates | ASTM D 2007 |
| Viscosity Index | ASTM D 2270 |
| Sulfur | ASTM D 2622 |
| | ASTM D 4294 |
| | ASTM D 4927 |
| | ASTM D 3120 |

The dispersant composition of the present invention can be incorporated into the lubricating oil in any convenient way. Thus, the dispersant composition of the invention can be added directly to the oil by dispersing or dissolving the same in the oil at the desired level of concentrations. Such blending into the lubricating oil can occur at room temperature or elevated temperatures. Alternatively, the compounds of the invention can be blended with a suitable oil-soluble solvent and base oil to form a concentrate, and then blending the concentrate with a lubricating oil basestock to obtain the final formulation. Such concentrates will typically contain (on an active ingredient (A.I.) basis from about 10 to about 35 wt. %, and preferably from about 20 to about 30 wt. %, of the inventive composition, and typically from about 40 to 80 wt. %, preferably from about 50 to 70 wt. %, base oil, based on the concentrate weight. To provide sufficient dispersing characteristics, the fully formulated lubricating oil composition should contain from about 0.5 to about 10 wt. %, preferably from about 1 to about 8 wt. %, most preferably from about 1.5 to about 5 wt. % (based on A.I.) of the dispersant composition of the present invention.

Additional additives may be incorporated into the compositions of the invention to enable particular performance requirements to be met. Examples of additives which may be included in the lubricating oil compositions of the present invention are detergents, metal rust inhibitors, viscosity index improvers, corrosion inhibitors, oxidation inhibitors, friction modifiers, anti-foaming agents, anti-wear agents and pour point depressants. Some are discussed in further detail below.

Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents may have a TBN of 150 or greater, and typically will have a TBN of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450, neutral and overbased calcium phenates and sulfurized phenates having TBN of from 50 to 450 and neutral and overbased magnesium or calcium salicylates having a TBN of from 20 to 450. Combinations of detergents, whether overbased or neutral or both, may be used. In one preferred lubricating oil composition, a dispersant composition of the invention is used in combination with an overbased salicylate detergent. In another preferred lubricating oil composition, a dispersant composition of the invention is used in combination with a neutral detergent.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 wt. % (preferably at least 125 wt. %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

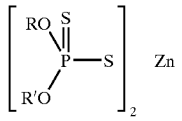

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. The present invention may be particularly useful when used with lubricant compositions containing phosphorus levels of from about 0.02 to about 0.12 wt. %, preferably from about 0.03 to about 0.10 wt. %. More preferably, the phosphorous level of the lubricating oil composition will be less than about 0.08 wt. %, such as from about 0.05 to about 0.08 wt. %.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons or esters, phosphorous esters, metal thiocarbamates, oil soluble copper compounds as described in U.S. Pat. No. 4,867,890, and molybdenum-containing compounds.

Aromatic amines having at least two aromatic groups attached directly to the nitrogen constitute another class of compounds that is frequently used for antioxidancy. While these materials may be used in small amounts, preferred embodiments of the present invention are free of these compounds. They are preferably used in only small amounts, i.e., up to 0.4 wt. %, or more preferably avoided altogether other than such amount as may result as an impurity from another component of the composition.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil soluble aromatic amines having at least two aromatic groups attached directly to one amine nitrogen should preferably not exceed 0.4 wt. % active ingredient.

Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene.

Friction modifiers and fuel economy agents that are compatible with the other ingredients of the final oil may also be included. Examples of such materials include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine. A preferred lubricating oil composition contains a dispersant composition of the present invention, base oil, and a nitrogen-containing friction modifier.

Other known friction modifiers comprise oil-soluble organo-molybdenum compounds. Such organo-molybdenum friction modifiers also provide antioxidant and antiwear credits to a lubricating oil composition. As an example of such oil soluble organo-molybdenum compounds, there may be mentioned the dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formula $$Mo(ROCS_2)_4 \text{ and}$$

$$Mo(RSCS_2)_4$$

wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of

1

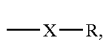

2

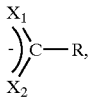

3

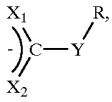

4

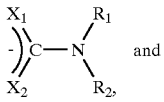

and

5

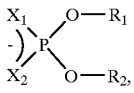

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).

2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.).

3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds of the present invention requires selection of ligands having the appropriate charge to balance the core's charge.

Compounds having the formula $Mo_3S_kL_nQ_z$ have cationic cores surrounded by anionic ligands and are represented by structures such as

6

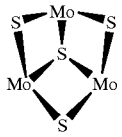

and

7

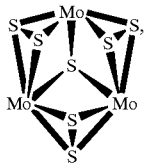

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. Such structures fall within the scope of this invention. This includes the case of a multidentate ligand having multiple connections to a single core. It is believed that oxygen and/or selenium may be substituted for sulfur in the core(s).

Oil-soluble or dispersible trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulfide, dialkyldithiocarbamate, or dialkyldithiophosphate, and a sulfur abstracting agent such cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. In the compounds of the present invention, at least 21 total carbon atoms should be present among all the ligand's organo groups. Preferably, the ligand source chosen has a sufficient number of carbon atoms in its organo groups to render the compound soluble or dispersible in the lubricating composition.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The molybdenum compound is preferably an organo-molybdenum compound. Moreover, the molybdenum compound is preferably selected from the group consisting of a molybdenum dithiocarbamate (MoDTC), molybdenum dithiophosphate, molybdenum dithiophosphinate, molybdenum xanthate, molybdenum thioxanthate, molybdenum sulfide and mixtures thereof. Most preferably, the molybdenum compound is present as molybdenum dithiocarbamate. The molybdenum compound may also be a trinuclear molybdenum compound.

In another preferred lubricating oil composition, a dispersant composition of the invention is used in combination with an oil soluble organo-molybdenum compound.

A viscosity index improver dispersant functions both as a viscosity index improver and as a dispersant. Examples of viscosity index improver dispersants include reaction products of amines, for example polyamines, with a hydrocarbyl-substituted mono -or dicarboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated monocarboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralised with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine or alcohol. A preferred lubricating oil composition contains a dispersant composition of the present invention, base oil, and a viscosity index improver dispersant.

Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates. Foam control can be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

In the present invention it may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

When lubricating compositions contain one or more of the above-mentioned additives, each additive is typically blended into the base oil in an amount that enables the additive to provide its desired function. Representative effective amounts of such additives, when used in crankcase lubricants, are listed below. All the values listed are stated as mass percent active ingredient.

| ADDITIVE | MASS % (Broad) | MASS % (Preferred) |
|---|---|---|
| Metal Detergents | 0.1–15 | 0.2–9 |
| Corrosion Inhibitor | 0–5 | 0–1.5 |
| Metal Dihydrocarbyl Dithiophosphate | 0.1–6 | 0.1–4 |
| Antioxidant | 0–5 | 0.01–2 |
| Pour Point Depressant | 0.01–5 | 0.01–1.5 |
| Antifoaming Agent | 0–5 | 0.001–0.15 |
| Supplemental Antiwear Agents | 0–1.0 | 0–0.5 |
| Friction Modifier | 0–5 | 0–1.5 |
| Viscosity Modifier | 0.01–10 | 0.25–3 |
| Basestock | Balance | Balance |

Preferably, the Noack volatility of the fully formulated lubricating oil composition (oil of lubricating viscosity plus all additives) will be no greater than 12, such as no greater than 10, preferably no greater than 8.

It may be desirable, although not essential, to prepare one or more additive concentrates comprising additives (concentrates sometimes being referred to as additive packages) whereby several additives can be added simultaneously to the oil to form the lubricating oil composition.

The final composition may employ from 5 to 25 mass %, preferably 5 to 18 mass %, typically 10 to 15 mass % of the concentrate, the remainder being oil of lubricating viscosity.

This invention will be further understood by reference to the following examples, wherein all parts are parts by weight, unless otherwise noted and which include preferred embodiments of the invention.

EXAMPLES

The VW TDi engine test is the latest version of a series of "diesel deposit tests" of increasing severity. It is acknowledged within the industry as a very severe test of a lubricant's performance capabilities, to the extent that passing the test can in many ways dictate the way a lubricant is formulated.

The TDi is a 4 cylinder, 1.9 liter 81 kW passenger car diesel engine. It is a direct injection engine, with a turbocharger system used to increase the power output of the unit. The industry test procedure consists of a repeating cycle of hot and cold running conditions; the so called PK cycle. This involves a 30 minute idle period at zero load (the K (Kalt) part), followed by 150 minutes at full load and 4150 rpm (the P (power part)). The entire cycle is then repeated for a total of 54 hours. In this 54 hour period there is no top up of the initial oil fill of 4.5 liters of candidate lubricant. Thus, losses due to evaporation, combustion and other physical loss mechanisms are accepted.

During the PK cycle, the temperature of the bulk oil in the sump rises from around 40° C. in the cold regime to 145° C. in the power regime. The temperatures of the piston is much higher, with the top two piston rings estimated to be experiencing temperatures of around 250–270° C. This illustrates the harsh conditions that engine oil lubricants need to endure and why the TDi is recognised as a severe test of lubricant capabilities. At the end of the 54 hour test the engine is drained and disassembled and the pistons are then rated for piston deposits and piston ring sticking. This affords a result assessed relative to an industry reference oil (RL206) to define passing or failing performance.

The pistons are rated against the DIN rating system, which examines and rates area of deposit coverage and to a limited extent deposit type. The 3 piston grooves and the 2 piston lands that lie between the grooves are rated on a merit scale for deposits and given a rating out of 100; the higher the number the better, 100 signifies totally clean, 0 signifies totally covered with deposit. The 5 segment ratings are then averaged to give the overall piston cleanliness merit rating. The scores for each of the 4 pistons are then averaged to afford the overall piston cleanliness for the test.

The rings are also assessed for ring sticking, which can occur due to excessive deposit build up in the grooves. This is then reported as an average over the rings on all the pistons, and also the maximum ring sticking observed across the 4 pistons. This test provides a good measure of piston cleanliness at the end of the test, but provides little insight into what occurs in the intervening 54 hours, while the test is being run.

In order to afford greater insight into the deposit build-up mechanism and better evaluate performance-affecting areas, VW TDi procedure can be altered to obtain intermediate piston ratings. To do so, the engine is stopped every 12 hours, drained, stripped and rated, put back together, the original test oil put back into the engine, which is then restarted. From this modified test, it was found that deposits rapidly build up in groove 1 (which can lead to ring sticking), and that it is not uncommon for groove 3 to remain essentially clean throughout the entire 54 hour test. Thus, the significant point of observation in the test should be groove 2, on which deposits build, but which does not experience sufficient build-up to cause a ring-sticking problem. However, due to the averaging of the results across the 5 piston segments in the standard VW TDi test procedure, this marked response is essentially obscured. Thus, in the modified VW TDi test procedure, the engine is run for 36 hours (the test duration that affords maximum differentiation between reference oils), and only groove 2 response is considered.

Using the modified VW TDi test procedure, as defined supra, lubricating oil compositions of the present invention were compared with non-conforming compositions. All the tested compositions contained the same commercially available group III basestock oil, the same amount of additive package containing dispersant(s) and other usual performance additives and the same amount of viscosity modifier. The additive packages differed only by the dispersant or dispersants employed. These high molecular weight dispersants (all having a comparable $M_n$ of about 2200) are characterized in Table 1, below:

TABLE 1

| Disp. # | Polymer MWD | Amine | Func. | % N | % B |
|---|---|---|---|---|---|
| D1 | 2.1 | PEHA | 1.0 | 0.7 | 0.00 |
| D2 | 2.1 | PAM | 1.2 | 0.89 | 0.00 |
| D3 | 2.2 | PAM | 1.4 | 1.20 | 0.00 |
| D4 | * | N3/N4/PAM | 1.8 | 1.09 | 0.00 |
| D5 | 1.8 | PAM | 1.4 | 1.03 | 0.00 |
| D6 | 1.8 | PAM | 1.6 | 1.22 | 0.00 |
| D7 | 2.2 | PAM | 1.4 | 1.07 | 0.27 |
| D8 | 2.2 | PAM | 1.4 | 1.06 | 0.14 |

*the commercial product of another manufacturer for which the MWD was not known and could not be readily determined but is believed to be above 2.0.

Using the above-identified dispersants, or mixtures thereof, lubricating oils were formulated as shown in Table 2, below:

TABLE 2

| Oil # | Disp. # | B/N | Func. | Hrs. to PCAV = 65 | PC Merit G2 @ 36 hrs. |
|---|---|---|---|---|---|
| 1 | D1 | 0.00 | 1.0 | 29 | 66 |
| 2 | D2 | 0.00 | 1.2 | 21 | 51 |
| 3 | D3 | 0.00 | 1.4 | 30 | 57 |
| 4 | D4 | 0.00 | 1.8 | 17 | 31 |
| 5 | D5 | 0.00 | 1.4 | 56 | 80 |
| 6 | D6 | 0.00 | 1.6 | 35 | 76 |
| 7 | D7 | 0.25 | 1.4 | 26 | 46 |
| 8 | D8 | 0.13 | 1.4 | 50 | 88 |
| 9 | D1/D7 | 0.14 | 1.0/1.4 | 51 | 81 |

The above-data (Oils 1–4) demonstrate that raising functionality to achieve higher nitrogen content for optimum sludge/varnish and soot viscosity control results in deteriorating piston cleanliness results. This is shown by the impact of functionality on the second groove cleanliness merit (PC Merit G2 @36 hrs) and on number of hours the oil lasts before dipping to 65 average merits (Hrs to Pcav=65). A comparison between Oils 1–3 and Oils 5–6 demonstrates the improvement brought by the narrow molecular weight distribution of the precursor polymer making up the dispersant. Again too high a functionality causes performance to diminish. Oils 7–9 relative to Oil 3 illustrates the improvement brought by boration using moderate functionality systems and the surprising dependence on boron to nitrogen ratio. Thus, moderate functionality can be combined with narrow MWD polymers, and preferably light boration to achieve optimum nitrogen for sludge/varnish and soot viscosity control (from the higher functionality) without compromising piston deposit control. Highly functionalized dispersants provide unacceptable piston cleanliness characteristics (Oil 4).

To demonstrate the effect of the Noack volatility of the base oil on VW Tdi results, independent of the dispersant composition, samples were prepared using identical commercial DI additive package and viscosity modifiers and base oils having a Noack volatility above and below 13.5%. Results are shown in Table 4:

| Oil # | Noack Volatility (oil) | Noack Volatility (composition) | PCAV Merit @ 54 hrs |
|---|---|---|---|
| 10 | 14.3 | 12.3 | 66 |
| 11 | 12.9 | 9.9 | 70 |

It should be noted that the lubricating oil compositions of this invention comprise defined, individual, i.e., separate, components that may or may not remain the same chemically before and after mixing. Thus, it will be understood that various components of the composition, essential as well as optional and customary, may react under the conditions of formulation, storage or use and that the invention also is directed to, and encompasses, the product obtainable, or obtained, as a result of any such reaction.

The disclosures of all patents, articles and other materials described herein are hereby incorporated, in their entirety, into this specification by reference. The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting. Changes may be made by those skilled in the art without departing from the spirit of the invention.

What is claimed is:

1. A dispersant comprising a reaction product of a polyalkenyl-substituted mono- or dicarboxylic acid, anhydride or ester; and a polyamine, having from greater than about 1.3 to less than about 1.7 mono- or di-carboxylic acid producing moieties per polyalkenyl moiety and wherein said polyalkenyl moiety has a molecular weight distribution ($M_w/M_n$) of from about 1.5 to about 2.0 and a number average molecular weight ($M_n$) of from about 1800 to about 3000.

2. The dispersant of claim 1, wherein said polyalkenyl-substituted mono- or dicarboxylic acid, anhydride or ester is polyisobutene succinic anhydride.

3. The dispersant of claim 2, wherein the polyisobutene moiety from which said polyisobutene succinic anhydride is derived has a terminal vinylidene content of at least 65 wt. %.

4. The dispersant of claim 3, wherein said polyisobutene moiety comprises HR-PIB.

5. The dispersant of claim 1, wherein said polyamine has on average from about 6 to about 7 nitrogen atoms per molecule.

6. The dispersant of claim 1, wherein said reaction product has from greater than about 1.3 to about 1.6 mono- or dicarboxylic acid producing moieties per polyalkenyl moiety.

7. The dispersant of claim 1, wherein said polyamine comprises at least one primary amine moiety, and said dispersant is derived from about 0.8 to about 1.0 succinyl moieties per primary amine moiety of said polyamine.

8. A lubricating oil composition comprising a major amount of oil of lubricating viscosity and a minor amount of a dispersant of claim 1.

9. The lubricating oil composition of claim 8, further comprising boron in an amount sufficient to provide a ratio of wt. % boron to wt. % of dispersant nitrogen (B/N), based on the total weight of said composition, of from about 0.05 to about 0.24.

10. The lubricating oil composition of claim 9, wherein said B/N ratio is from about 0.10 to about 0.15.

11. The lubricating oil composition of claim 9, wherein said boron is provided by a borated dispersant.

12. The lubricating oil composition of claim 9, wherein said boron is provided by a second dispersant having a B/N ratio of greater than 0.24 and a functionality of less than 1.3.

13. The dispersant composition of claim 9, wherein boron is provided to said composition by a boron source other than a borated dispersant.

14. The dispersant composition of claim 13, wherein said boron source is selected from the group consisting of borated dispersant VI improver; alkali metal, mixed alkali metal or alkaline earth metal borate; borated overbased metal detergent; borated epoxide; borate ester; and borate amide.

15. The dispersant composition of claim 9, wherein the boron content of said composition is from about 0.2 to about 0.8 wt. %, based on the total weight of active dispersant.

16. The lubricating oil composition of claim 9, wherein said oil of lubricating viscosity is a Group 3 oil, a Group 4 oil, a Group 5 oil, or a mixture thereof.

17. The lubricating oil composition of claim 9, wherein said oil of lubricating viscosity has a Noack volatility of not greater than 13.5% and a viscosity index (VI) of at least 120.

18. The lubricating oil composition of claim 17, wherein the Noack volatility of said composition is no greater than 12%.

19. The lubricating oil composition of claim 9, further comprising minor amounts of at least one additional additive selected from the group consisting of molybdenum-containing antiwear agents or antioxidants, calcium salicylate detergents and neutral detergents.

20. The lubricating oil composition of claim 10, wherein phosphorous content is no greater than 0.08 wt. %, based on the total weight of said lubricating oil composition.

21. A lubricating oil composition comprising a major amount of an oil of lubricating viscosity and from about 1 to about 7 wt. %, based on the total weight of the lubricating oil composition, of the dispersant of claim 1.

22. An additive concentrate comprising from about 20 to 90 wt. % of a normally liquid, substantially inert, organic solvent or diluent, and from about 10 to about 90 wt. % of additives including a dispersant of claim 1.

23. A method of improving cleanliness of the pistons of an internal combustion engine in operation, said method comprising lubricating said engine with a lubricating oil composition as claimed in claim 21.

* * * * *